US008047170B2

(12) United States Patent
Strauss et al.

(10) Patent No.: US 8,047,170 B2
(45) Date of Patent: Nov. 1, 2011

(54) DEVICE FOR VARIABLY ADJUSTING CONTROL TIMES OF GAS EXCHANGE VALVES OF AN INTERNAL COMBUSTION ENGINE

(75) Inventors: Andreas Strauss, Forchheim (DE); Michael Busse, Herzogenaurach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 347 days.

(21) Appl. No.: 12/307,951

(22) PCT Filed: Jun. 21, 2007

(86) PCT No.: PCT/EP2007/056197

§ 371 (c)(1),
(2), (4) Date: Apr. 10, 2009

(87) PCT Pub. No.: WO2008/006685

PCT Pub. Date: Jan. 17, 2008

(65) Prior Publication Data

US 2010/0000479 A1 Jan. 7, 2010

(30) Foreign Application Priority Data

Jul. 8, 2006 (DE) ..... 10 2006 031 594

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 2002/0100445 | A1 | 8/2002 | Takenaka et al. | |
| 2003/0121486 | A1 | 7/2003 | Komazawa et al. | |
| 2004/0112314 | A1 * | 6/2004 | Kanada et al. | 123/90.17 |
| 2006/0075983 | A1 | 4/2006 | Schmitt | |

FOREIGN PATENT DOCUMENTS

| | | |
|---|---|---|
| DE | 19844473 | 4/1999 |
| DE | 19914767 | 10/1999 |
| DE | 19918910 | 11/1999 |
| DE | 102006061036 | 7/2007 |
| EP | 0857859 | 8/1998 |
| EP | 1302630 | 4/2003 |

* cited by examiner

*Primary Examiner* — Zelalem Eshete
(74) *Attorney, Agent, or Firm* — Volpe And Koenig, P.C.

(57) ABSTRACT

A device (10) for variably adjusting control times of gas exchange valves (9*a*, 9*b*) of an internal combustion engine (1), including an external rotor (22) and an internal rotor (23) that is arranged such that it can rotate in relation to the external rotor. One of the components is drivingly connected to the crankshaft (2) and the other component is drivingly connected to the camshaft (6, 7). At least one pressure chamber (33) is provided and each of the pressure chambers (33) is divided into two counter-working pressure chambers (35, 36). One of the working chambers (35, 36) of each pressure chamber (33) acts as an advance chamber and the other pressure chamber (35, 36) as a retarding chamber. At least two rotation angle limiting devices (42, 43) are provided, with each of the rotation angle limiting devices (42, 43) being able to assume an unlocked state and locked state. The locked state can be adjusted by supplying or withdrawing a pressure medium to and from the respective rotation angle limiting devices (42, 43).

18 Claims, 5 Drawing Sheets

DEVICE FOR VARIABLY ADJUSTING CONTROL TIMES OF GAS EXCHANGE VALVES OF AN INTERNAL COMBUSTION ENGINE

BACKGROUND

The invention relates to a method for controlling a device for variably adjusting the control times of gas-exchange valves of an internal combustion engine according to the preamble of Claim 1, to a method for controlling a device for variably adjusting the control times of gas-exchange valves of an internal combustion engine according to the preamble of Claim 6, and to a device for variably adjusting the control times of gas-exchange valves of an internal combustion engine according to the preamble of Claim 11.

In modern internal combustion engines, devices for variably adjusting the control times of gas-exchange valves are used in order to vary the phase relationship between the crankshaft and the camshaft in a defined angular region between a maximum advanced position and a maximum retarded position. For this purpose, the device is integrated into a drive train by which torque is transferred from the crankshaft to the camshaft. This drive train can be realized, for example, as a belt, chain, or gear train.

The device comprises at least two rotors that can rotate opposite each other, wherein one rotor is drivingly connected to the crankshaft and the other rotor is locked in rotation with the camshaft. The device comprises at least one pressure space that is divided by a movable element into two pressure chambers acting against each other. The moving element is in active connection with at least one of the rotors. By supplying pressure medium to the pressure chambers or by withdrawing pressure medium from the chambers, the moving element is shifted within the pressure space, by which a selective rotation of the rotors relative to each other and thus the camshaft to the crankshaft is realized.

The supply of pressure medium to the pressure chambers or the withdrawal of pressure medium from the pressure chambers is controlled by a control unit, usually a hydraulic directional valve (control valve). The control unit is controlled, in turn, by a controller that determines and compares the actual and desired positions of the camshaft in the internal combustion engine. If there is a difference between the two positions, a signal is transmitted to the control unit that adapts the pressure medium flows to the pressure chambers to this signal.

In order to guarantee the function of the device, the pressure in the pressure medium circuit of the internal combustion engine must exceed a certain value. Because the pressure medium is usually provided by the oil pump of the internal combustion engine and the provided pressure thus increases in sync with the rpm's of the internal combustion engine, below a certain rpm number, the oil pressure is still too low to change or maintain the phase position of the rotors. This can be the case, for example, during the startup phase of the internal combustion engine or during idling phases.

During these phases, the device would execute uncontrolled oscillations, which leads to increased noise emissions, increased wear, non-smooth running, and increased raw emissions of the internal combustion engine. In order to be able to prevent this, mechanical locking devices are provided that couple the two rotors with each other locked in rotation during the critical operating phases of the internal combustion engine, wherein this coupling can be cancelled by applying pressure medium to the locking device. In this way, for the locking position it has proven advantageous to select a phase position of the camshaft relative to the crankshaft that lies between the maximum advanced position and the maximum retarded position.

Such a device is known, for example, from US 2003/0121486 A1. In this embodiment, the device has a rotary piston construction, wherein an external rotor is supported such that it can rotate on an internal rotor constructed as an impeller wheel. In addition, two rotational angle limiting devices are provided, wherein a first rotational angle limiting device allows, in the locked state, an adjustment of the internal rotor relative to the external rotor in an interval between a maximum retarded position and a defined middle position (locking position). The second rotational angle limiting device allows, in the locked state, a rotation of the internal rotor relative to the external rotor in an interval between the middle position and the maximum advanced position. If both rotational angle limiting devices are in the locked state, then the phase position of the internal rotor relative to the external rotor is limited to the middle position.

Each of the rotational angle limiting devices is made from a spring-loaded locking pin that is arranged in a receptacle of the external rotor. Each locking pin is loaded with a force by a spring in the direction of the internal rotor. On the internal rotor, a locking groove is formed that stands opposite the locking pins in certain operating positions of the devices. In these operating positions, the pins can engage in the locking groove. In this way, each rotational angle limiting device transitions from the unlocked state into the locked state.

Each of the rotational angle limiting devices can transition from the locked state into the unlocked state by applying pressure medium to the locking groove. In this case, the pressure medium forces the locking pins back into their receptacles, whereby the mechanical coupling of the internal rotor to the external rotor is cancelled.

Applying pressure medium to the pressure chambers and the locking groove is realized by a control valve, wherein on the control valve there are, among other things, two work ports that communicate with the pressure chambers and one control port that communicates with the locking groove. The fact that both rotational angle limiting devices are changed from the locked state into the unlocked state by one and the same control line is a disadvantage in the shown embodiment. In this embodiment, during an adjustment process, both rotational angle limiting devices must be unlocked, that is, loaded with pressure medium, while pressure medium is alternately supplied to the pressure chambers and withdrawn from these pressure chambers. This leads to complicated control logic of the control valve. First, a plurality of control positions are required, wherein the switch points between the control positions must be constantly redefined during the operation of the internal combustion engine due to operating-dependent variations, for example, as a result of temperature changes. In addition, the setting of the individual control states requires a higher precision of the controller system, because the flow supplied to the valve has to lie within tightly bounded flow value intervals due to the plurality of control positions. This produces a plurality of computational and data-processing operations, whereby high requirements are placed on the control electronics. In addition, the phase accuracy of the device suffers, because even small deviations in the control loop have the effect that an undesired control state is set.

In addition, in this embodiment it is provided, during the startup phase of the internal combustion engine, to connect all of the pressure chambers and the locking groove to a tank, which leads to an inadequate supply of lubricant to the device and thus to increased wear.

Alternatively, pressure medium provided in another embodiment is to be supplied to one of the chambers and thus a sufficient lubricant supply is to be guaranteed. However, in this embodiment the internal rotor is clamped hydraulically opposite the external rotor. This can lead to jamming of the locking pins at the edges of the locking groove, by which hydraulic unlocking is made more difficult or optionally even prevented.

SUMMARY

The invention is based on the objective of creating a device for the variable adjustment of the control times of gas-exchange valves of an internal combustion engine and specifying a method for controlling this device, wherein the internal rotor can be locked mechanically relative to the external rotor in a middle phase position between the maximum advanced position and the maximum retarded position. In this way, a secure locking shall be guaranteed when the internal combustion engine is stopped or at least during its startup process, undesired automatic unlocking during the startup phase of the internal combustion engine can be avoided, the device is supplied with sufficient lubricant at all times, and a secure adjustment past the locking position can be guaranteed, wherein the individual control states of the control valve shall be easy to determine and maintain.

In one embodiment of a device for variably adjusting the control times of gas-exchange valves of an internal combustion engine with an external rotor and an internal rotor that can rotate relative to this external rotor, wherein one of the components is drivingly connected to a crankshaft and the other component is drivingly connected to a camshaft, wherein at least one pressure space is formed and each pressure space is divided into two pressure chambers acting against each other, wherein one of the pressure chambers of each pressure space acts as an advancing chamber and the other pressure chamber acts as a retarding chamber, wherein by supplying pressure medium to the advancing chambers while simultaneously withdrawing pressure medium from the retarding chambers, the rotor interacting with the camshaft is rotated relative to the rotor interacting with the crankshaft in the direction of a maximum advanced position, wherein by supplying pressure medium to the retarding chambers while simultaneously withdrawing pressure medium from the advancing chambers, the rotor interacting with the camshaft is rotated relative to the rotor interacting with the crankshaft in the direction of a maximum retarded position, wherein at least one first and one second rotational angle limiting device are provided, wherein each rotational angle limiting device can assume an unlocked state and a locked state, wherein the locking state can be set by supplying pressure medium to or withdrawing pressure medium from the respective rotational angle limiting device, wherein for a locked first and second rotational angle limiting device the internal rotor is fixed relative to the external rotor in a locking position, wherein a control valve is provided that can assume several control positions and controls the supply of pressure medium to or the withdrawal of pressure medium from the pressure chambers and the rotational angle limiting devices, wherein the control valve has at least one inflow port, at least one outflow port, at least two work ports, and at least one separate control port, wherein the inflow port communicates with a pressure medium pump, the outflow port communicates with a tank, the first work port communicates with the advancing chambers, the second work port communicates with the retarding chambers, and the control port communicates with at least one of the rotational angle limiting devices, the objective is met according to the invention in that the control valve has a startup position in which one of the work ports is connected neither to the outflow port nor to the inflow port and that the other work port and the rotational angle limiting devices communicate exclusively with the outflow port in the startup phase.

In one embodiment there is an actuator that can move the control valve into various control position, wherein the control valve assumes the startup position for a non-activated or alternatively for a maximum activated actuator.

In this way, it can be provided that, in the locked state, the first rotational angle limiting device prevents the rotation of the rotor interacting with the camshaft relative to the rotor interacting with the crankshaft in the direction of the maximum advanced position when the locking position is assumed.

In addition it can be provided that, in the locked state, the first rotational angle limiting device limits the phase position of the rotor interacting with the camshaft relative to the rotor interacting with the crankshaft to an angle region between the maximum retarded position and the locking position.

In one alternative embodiment, in the locked state, the second rotational angle limiting device limits a phase position of the rotor interacting with the camshaft relative to the rotor interacting with the crankshaft to an angle region between the maximum advanced position and the locking position.

Advantageously, the second rotational angle limiting device communicates exclusively with the control port.

In one advantageous refinement of the invention it is provided that the control valve also has an unlocking position in which the control port communicates with the inflow port and the work ports do not communicate with the inflow port.

In addition, it can be provided that the control valve also has a retarding position in which the first work port communicates with the tank and the second work port and the control port communicate with the inflow port.

In addition, the control valve can have an advancing position in which the first work port is connected to the inflow port and the second work port and the control port are connected to the tank.

In this way, with increasing or alternatively decreasing excitation of the actuator, the control positions are assumed in the sequence: startup positions-unlocking position-retarding position-advancing position.

In a first method for controlling a device for variably adjusting the control times of gas-exchange valves of an internal combustion engine with an external rotor and an internal rotor that can rotate relative to this external rotor, wherein one of the components is drivingly connected to a crankshaft and the other component is drivingly connected to a camshaft, wherein at least one pressure space is provided and each pressure space is divided into two pressure chambers acting against each other, wherein one of the pressure chambers of each pressure space acts as an advancing chamber and the other pressure chamber acts as a retarding chamber, wherein by supplying pressure medium to the advancing chambers while simultaneously withdrawing pressure medium from the retarding chambers, the rotor interacting with the camshaft is rotated relative to the rotor interacting with the crankshaft in the direction of a maximum advanced position, wherein by supplying pressure medium to the retarding chambers while simultaneously withdrawing pressure medium from the advancing chambers, the rotor interacting with the camshaft is rotated relative to the rotor interacting with the crankshaft in the direction of a maximum retarded position, wherein at least one first and one second rotational angle limiting device are provided, wherein each rotational angle limiting device can assume an unlocked and a locked state, wherein the locking state can be set by supplying pressure medium to or withdrawing pressure medium from the respective rotational angle limiting device, wherein for a locked first and second rotational angle limiting device, the internal rotor is fixed relative to the external rotor in a locking position, wherein the supply of pressure medium to or the withdrawal of pressure medium from the pressure chambers and the rotational angle limiting devices can be set by a connection to a pressure medium pump or to a tank, the objective according to the invention is met in that during a startup phase of the internal combustion engine, the retarding chambers or the advancing chambers are connected neither to the tank nor to the pressure medium pump and the other pressure chambers and the rotational angle limiting devices are connected to a tank.

In one embodiment of the invention, it can be provided that, in the locked state, the first rotational angle limiting device prevents the rotation of the rotor interacting with the camshaft relative to the rotor interacting with the crankshaft in the direction of the maximum advanced position when the locking position is assumed.

Alternatively, it can be provided that, in the locked state, the first rotational angle limiting device limits the phase position of the rotor interacting with the camshaft relative to the rotor interacting with the crankshaft to an angle region between the maximum retarded position and the locking position.

In this way, in the locked state, the second rotational angle limiting device limits a phase position of the rotor interacting with the camshaft relative to the rotor interacting with the crankshaft advantageously to an angle region between the maximum advanced position and the locking position.

In one embodiment of the invention, it is provided that during a stop process of the internal combustion engine, the advancing chambers are connected to the pressure medium pump and the second rotational angle limiting device and the retarding chambers are connected to the tank.

In another method for controlling a device for variably adjusting the control times of gas-exchange valves of an internal combustion engine with an external rotor and an internal rotor that can rotate relative to this external rotor, wherein one of the components is drivingly connected to a crankshaft and the other component is drivingly connected to a camshaft, wherein at least one pressure space is provided and each pressure space is divided into two pressure chambers acting against each other, wherein one of the pressure chambers of each pressure space acts as an advancing chamber and the other pressure chamber acts as a retarding chamber, wherein by supplying pressure medium to the advancing chambers while simultaneously withdrawing pressure medium from the retarding chambers, the rotor interacting with the camshaft is rotated relative to the rotor interacting with the crankshaft in the direction of a maximum advanced position, wherein by supplying pressure medium to the retarding chambers while simultaneously withdrawing pressure medium from the advancing chambers, the rotor interacting with the camshaft is rotated relative to the rotor interacting with the crankshaft in the direction of a maximum retarded position, wherein at least one first and one second rotational angle limiting device are provided, wherein each rotational angle limiting device can assume an unlocked and a locked state, wherein the locking state can be set by supplying pressure medium to or withdrawing pressure medium from the respective rotational angle limiting device, wherein for the locked first and second rotational angle limiting device, the internal rotor is fixed relative to the external rotor in a locking position, wherein the supply of pressure medium to or the withdrawal of pressure medium from the pressure chambers and the rotational angle limiting devices can be set by a connection to a pressure medium pump or to a tank, and wherein, in the locked state, the second rotational angle limiting device limits the phase position of the rotor interacting with the camshaft relative to the rotor interacting with the crankshaft to an angle region between the maximum advanced position and the locking position, the object according to the invention is met in that during a stopping process of the internal combustion engine, the advancing chambers are connected to the pressure medium pump and the second rotational angle limiting device and the retarding chambers are connected to the tank.

In this way, it can be advantageously provided in both methods that the locking state of the second rotational angle limiting device is controlled exclusively by a separate control line that does not communicate with the pressure chambers.

In this way, it can be advantageously provided that the locking state of the first rotational angle limiting device is controlled by the pressure prevailing in at least one of the advancing chambers.

Advantageously, a control valve is provided that controls the supply of pressure medium to and the withdrawal of pressure medium from both the pressure chambers and also the second rotational angle limiting device.

In one development of the invention it is provided that the connections of the pressure chambers and the second rotational angle limiting device to the pressure medium pump or to the tank during the stop process of the internal combustion engine are maintained for a defined time span past the completed engine stop.

In the embodiment of the device according to the invention, a locking device is provided by which the external rotor can be coupled mechanically with the internal rotor in a locking position between a maximum advanced position and a maximum retarded position. Advantageously, two rotational angle limiting devices can be provided, wherein, in the locked state, one of the rotational angle limiting devices limits the relative phase position of the internal rotor relative to the external rotor to a region between the maximum advanced position and the locking position. In the locked state, the other rotational angle limiting device permits a phase position between the locking position and the maximum retarded position. Alternatively, this can be constructed as a locking element, wherein, in the locking position, a locking pin of the locking element engages in a recess or a blind hole adapted to the locking pin. Thus it is guaranteed that the internal rotor can be fixed mechanically relative to the external rotor in a middle phase position.

Each of the rotational angle limiting devices can be changed from the locked state to the unlocked state by applying pressure medium. In this way, the rotational angle limiting device that limits the relative rotation of the internal rotor to the external rotor in the locked state to a region between the maximum advanced position and the locking position communicates with a control line. The control line communicates neither with the pressure chambers nor with the pressure medium lines and the pressure medium channels that supply the pressure chambers with pressure medium.

Thus, the locking state of this rotational angle limiting device can be influenced independent of the pressure state of the pressure chambers. Through the separate control of one of the rotational angle limiting devices by a control line, it is thus possible to stop the device during the shutdown process in a defined interval that contains the locking position. During the shutdown process or alternatively during the restart of the internal combustion engine, the internal rotor is led automatically into the locking position, wherein the mechanical connection between the rotors is created by the rotational angle limiting devices. The locking position can be achieved, for example, by the drag moment acting on the camshaft. In this case, the internal rotor is brought relative to the external rotor into an interval between the locking position and the maximum advanced position. Alternatively, a spring element can be provided that exerts a torque acting against the drag moment on the internal rotor. If the spring torque exceeds the drag moment, then the targeted interval extends between the maximum retarded position and the locking position.

Because the control line is constructed independent of the pressure medium lines supplying the device, during the startup phase both rotational angle limiting devices can be connected to the tank, wherein a group of pressure chambers are connected neither with the tank nor with the pump. Thus, automatic unlocking of the device can be stopped. Simultaneously, the leakage oil entering the pressure medium lines via the control valve can be suctioned through a small, oscillating movement of the internal rotor relative to the external rotor. Therefore a sufficient supply of lubricant to the device is guaranteed even during the startup phase. The small, oscillating movement of the internal rotor relative to the external rotor results from the alternating moments acting on the camshaft in combination with a small locking play of the rotational angle limiting devices.

BRIEF DESCRIPTION OF THE DRAWINGS

Additional features of the invention emerge from the following description and from the drawings in which an embodiment of the invention is shown simplified. Shown are.

DETAILED DESCRIPTION OF THE PREFERRED EMBODIMENTS

Figure 1:
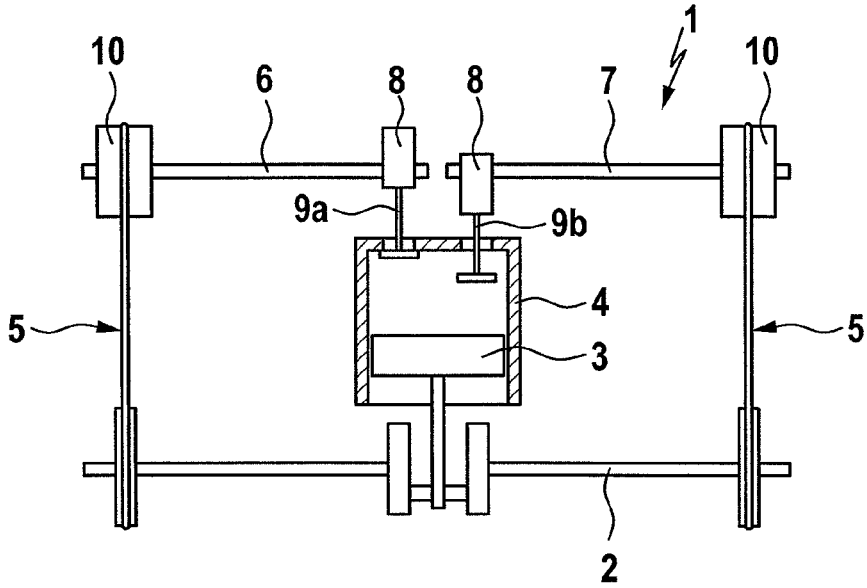
FIG. 1 is a schematic representation of an internal combustion engine.

In FIG. 1, an internal combustion engine 1 is schematically illustrated, wherein a piston 3 connected to a crankshaft 2 is shown in a cylinder 4. In the shown embodiment, the crankshaft 2 is connected to an intake camshaft 6 and/or an exhaust camshaft 7 by a traction mechanism drive 5, wherein a first and a second device 10 can provide for a relative rotation between the crankshaft 2 and the camshafts 6, 7. The cams 8 of the camshafts 6, 7 activate one or more intake gas-exchange valves 9*a* or one or more exhaust gas-exchange valves 9*b*. It also can be provided to equip only one of the camshafts 6, 7 with a device 10 or to provide only one camshaft 6, 7 that is provided with a device 10.

Figure 2A:
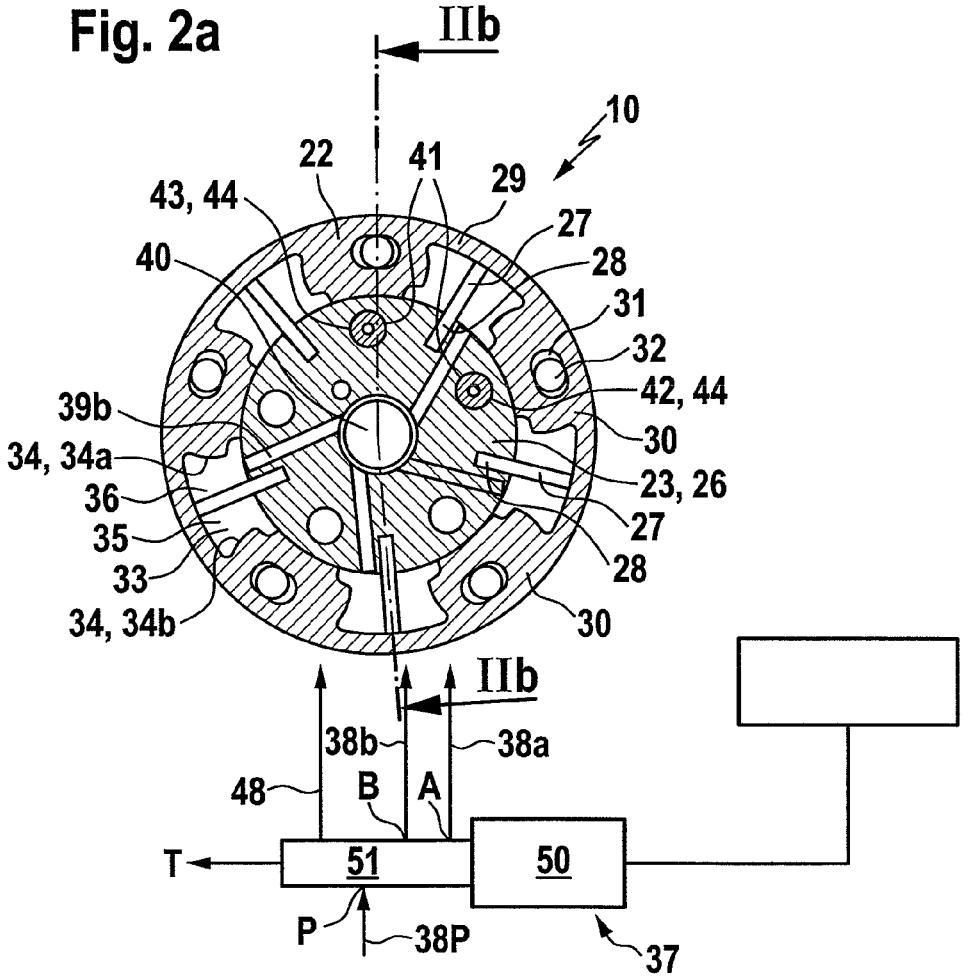
FIG. 2*a* is a cross-sectional view through an embodiment according to the invention of a device for changing the control times of gas-exchange valves of an internal combustion engine including an attached hydraulic circuit.
Figure 2B:
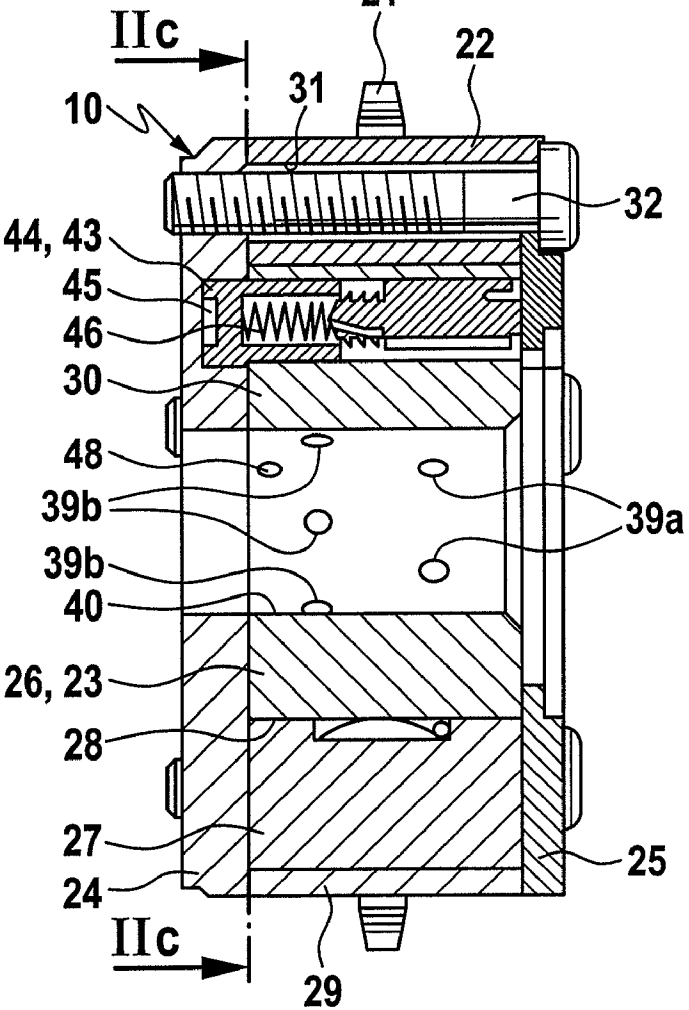
FIG. 2*b* is a longitudinal section view through the device from FIG. 2*a* along the line IIb-IIb.

FIGS. 2*a* and 2*b* show an embodiment of a device 10 according to the invention in cross section and in longitudinal section, respectively.

The device 10 has an external rotor 22, an internal rotor 23, and two side covers 24, 25. The internal rotor 23 is constructed in the form of an impeller wheel and has an essentially cylindrical hub element 26 from whose outer cylindrical lateral surface extend five vanes 27 outwardly in the radial direction in the shown embodiment. In this way, the vanes 27 can be formed integrally with the hub element 26. Alternatively, the vanes 27, as shown in FIG. 2*a*, can be constructed separately and can be arranged in axial vane grooves 28 formed on the hub element 26, wherein the vanes 27 are loaded with a force radially outwardly by not-shown spring elements arranged between the groove bases of the vane grooves 28 and the vanes 27.

Starting from an outer peripheral wall 29 of the external rotor 22, several projections 30 extend radially inwardly. In the shown embodiment, the projections 30 are formed integrally with the peripheral wall 29. Also conceivable, however, are embodiments in which instead of the projections 30 there are vanes that are attached to the peripheral wall 29 and extend radially inwardly. The external rotor 22 is supported on the internal rotor such that it can rotate relative to the internal rotor 23 by radially inwardly lying peripheral walls of the projections 30.

On an outer lateral surface of the peripheral wall 29 there is a chain wheel 21 by which torque can be transmitted from the crankshaft 2 to the external rotor 22 by a not-shown chain drive. The chain wheel 21 can be constructed as a separate component and locked in rotation with the external rotor 22 or can be constructed integrally with this internal rotor. Alternatively, a belt drive or gear drive can also be provided.

Each of the side covers 24, 25 is arranged on one of the axial side surfaces of the external rotor 22 and locked in rotation on this external rotor. In each of the projections 30 there is an axial opening 31 for this purpose, wherein each axial opening 31 is penetrated by an attachment element 32, for example, a bolt or a screw that is used for rotational fixing of the side covers 24, 25 on the external rotor 22.

Within the device 10, between every two projections 30 adjacent in the peripheral direction there is a pressure space 33 that is bounded in the peripheral direction by opposing, essentially radial boundary walls 34 of adjacent projections 30, in the axial direction by the side covers 24, 25, radially inwardly by the hub element 26, and radially outwardly by the peripheral wall 29. A vane 27 projects into each of the pressure spaces 33, wherein the vanes 27 are constructed such that these vanes contact both the side walls 24, 25 and also the peripheral wall 29. Each vane 27 thus divides the respective pressure space 33 into two pressure chambers 35, 36 acting against each other.

The external rotor 22 is arranged in a defined angular region so that it can rotate relative to the internal rotor 23. The angular region is bounded in one rotational direction of the external rotor 22 such that each vane 27 comes to lie against a boundary wall 34 of the pressure space 33 formed as an advance stop 34*a*. Analogously, the angular range in the other rotational direction is bounded such that each vane 27 comes to lie against the other boundary wall 34 of the pressure space 33 that acts as a retard stop 34*b*. Alternatively, a rotational angle limiting device can be provided that limits the rotational angle region of the external rotor 22 relative to the internal rotor 23.

By pressurizing one group of pressure chambers 35, 36 and depressurizing the other group, the phase position of the external rotor 22 relative to the internal rotor 23 can be varied. By pressurizing both groups of pressure chambers 35, 36, the phase position of the two rotors 22, 23 can be held constant relative to each other. Alternatively, it can be provided to pressurize none of the pressure chambers 35, 36 with pressure medium during phases of constant phase position. The lubricating oil of the internal combustion engine 1 is typically used as the hydraulic pressure medium.

For supplying pressure medium to or withdrawing pressure medium from the pressure chambers 35, 36, a pressure medium system is provided that comprises a not-shown pressure medium source, for example, a pressure medium pump, a similarly not-shown tank, a control valve 37, and several pressure medium lines 38*a*, 38*b*, 38*p*. Pressure medium fed from the pressure medium pump is supplied to the control valve 38 via the third pressure medium line 38*p*. According to the control state of the control valve 37, the third pressure medium line 38*p* is connected to the first pressure medium line 38*a*, the second pressure medium line 38*b*, or to both or none of the pressure medium lines 38*a*, 38*b*.

The internal rotor 23 is formed with two groups of pressure medium channels 39*a*, 39*b*, wherein each pressure medium channel 39*a*, 39*b* extends from an inner lateral surface of a receptacle 40 of the internal rotor 23 to one of the pressure chambers 35, 36. The first pressure medium line 38*a* communicates with the first pressure medium channels 39*a*. The second pressure medium line 38*b* communicates with the second pressure medium channels 39*b*. For this purpose, for example, a pressure medium distributor can be provided that is arranged in a receptacle 40. In one alternative embodiment, the control valve 37 is constructed as a central valve and is arranged in the receptacle 40, wherein, in this case, the control valve 37 connects the third pressure medium line 38*p* directly to the pressure medium channels 39*a*, 39*b*.

In order to shift the control times (opening and closing times) of the gas-exchange valves 9*a*, 9*b* in the advanced direction, the pressure medium supplied to the control valve 37 via the third pressure medium line 38*p* is led to the group of first pressure chambers 35 (advancing chambers) via the first pressure medium channels 39*a* and optionally the first pressure medium line 38*a*. Simultaneously, pressure medium is led out of the group of second pressure chambers 36 via the second pressure medium channels 39*b* and optionally the second pressure medium line 38*b* to the control valve 37 and is ejected into the tank. Therefore, the vanes 27 are shifted in the direction of the advance stop 34*a*, whereby a rotational movement of the internal rotor 23 relative to the external rotor 22 is achieved in the rotational direction of the device 10.

In order to shift the control times of the gas-exchange valves 9*a*, 9*b* in the retarded position, the pressure medium supplied to the control valve 37 via the third pressure medium line 38*p* is led via the second pressure medium channels 39*b* and optionally the second pressure medium line 38*b* to the group of second pressure chambers 36 (retarding chambers). Simultaneously, pressure medium is led out of the group of first pressure chambers 35 via the first pressure medium channels 39*a* and optionally the first pressure medium line 38*a* to the control valve 37 and is ejected into the tank. In this way, the vanes 27 are shifted in the direction of the retard stop 34*a*, whereby a rotational movement of the internal rotor 23 relative to the external rotor 22 is achieved against the rotational direction of the device 10.

In order to maintain the control times constant, the pressure medium supply to all of the pressure chambers 35, 36 is either stopped or permitted. Therefore, the vanes 27 are clamped hydraulically within each pressure space 33 and thus a rotational movement of the internal rotor 23 relative to the external rotor 22 is prevented.

During the startup of the internal combustion engine 1 or during idling phases, the pressure medium supply to the device 10 cannot be sufficient, in order to guarantee the hydraulic clamping of the vanes 27 within the pressure spaces 33. In order to prevent uncontrolled oscillation of the internal rotor 23 relative to the external rotor 22, there is a locking mechanism 41 that creates a mechanical connection between the two rotors 22, 23. For this, a locking pin is arranged in one of the rotors 22, 23, while a connecting passage is formed in the other rotor 22, 23. If the internal rotor 23 is located in a defined phase position (locking position) relative to the external rotor 22, then the locking pin can engage in the connecting passage and thus a mechanical, rotationally locked connection can be created between the two rotors 22, 23.

Figure 2C:
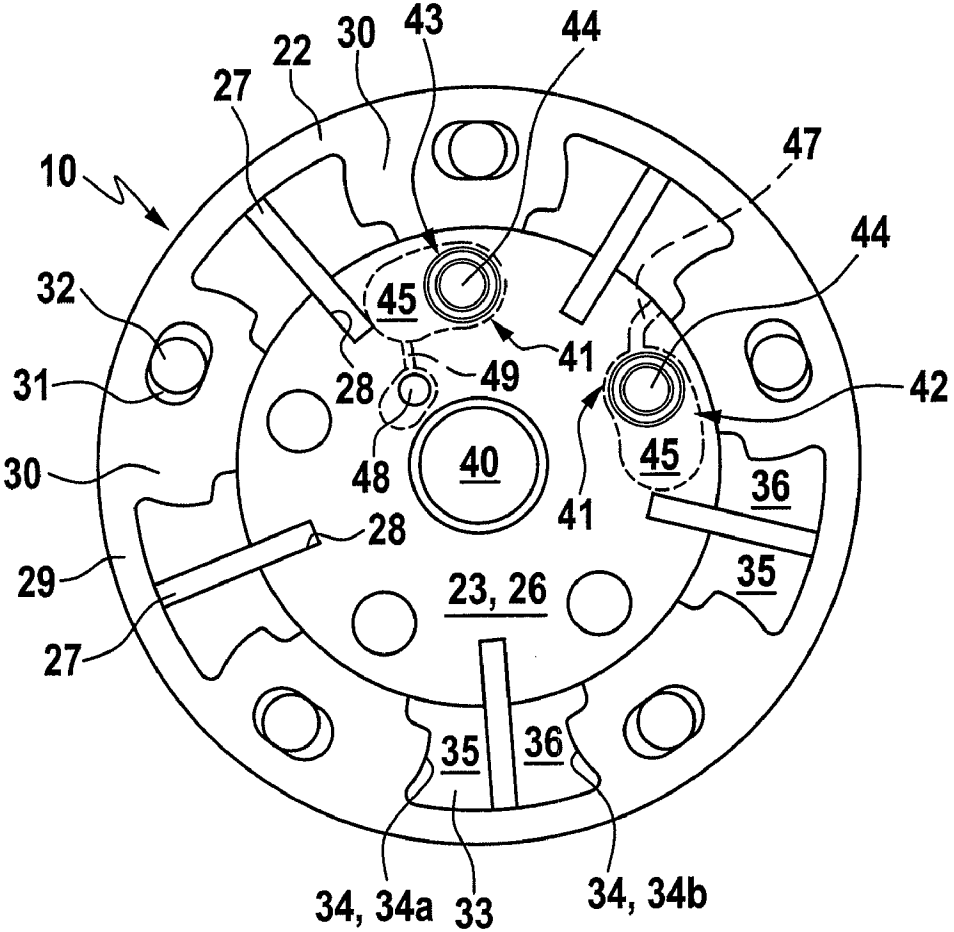
FIG. 2*c* is a cross-sectional view through the device from FIG. 2*b* along the line IIc-IIc.

It has proven advantageous to select the locking position such that the vanes 27 in the locked state of the device 10 are located in a position between the advance stop 34*a* and the retard stop 34*b*. Such a locking mechanism 41 is shown in FIG. 2*c*. These are made from a first and a second rotational angle limiting device 42, 43. In the shown embodiment, each of the rotational angle limiting devices 42, 43 is made from an axially displaceable locking pin 44, wherein each of the locking pins 44 is held in a borehole of the internal rotor 23. In addition, in the first side wall 24 there are two connecting passages 45 in the form of grooves running in the peripheral direction. These are indicated in FIG. 2*c* in the form of broken lines. Each of the locking pins 44 is loaded with a force in the direction of the first side cover 24 by a spring element 46. If the internal rotor 23 assumes a position relative to the external rotor 22 in which a locking pin 44 is opposite the associated connecting passage 45 in the axial direction, then this pin is forced into the connecting passage 45 and the respective rotational angle limiting device 42, 43 changes from an unlocked state into a locked state. In this way, the connecting passage 45 of the first rotational angle limiting device 42 is constructed such that the phase position of the internal rotor 23 relative to the external rotor 22 is limited, when the first rotational angle limiting device 42 is locked, to a region between a maximum retarded position and the locking position. If the internal rotor 23 is located relative to the external rotor 22 in the locking position, then the locking pin 44 of the first rotational angle limiting device 42 contacts a stop formed in the peripheral direction by the connecting passage 45, whereby further adjustment in the direction of more advanced control times is prevented.

Analogously, the connecting passage 45 of the second rotational angle limiting device 43 is designed such that for a locked section rotational angle limiting device 43, the phase position of the internal rotor 23 relative to the external rotor 22 is limited to a region between a maximum advanced position and the locking position.

In order to move the rotational angle limiting devices 42, 43 from the locked state into the unlocked state, it is provided that the respective connecting passage 45 is loaded with pressure medium. In this way, the respective locking pin 44 is forced back against the force of the spring element 46 into the borehole and thus the rotational angle limiting is cancelled.

In the shown embodiment, it is provided to supply the connecting passage 45 of the first rotational angle limiting device 42 with pressure medium via one of the first pressure chambers 35 and a connection line 47, wherein this first rotational angle limiting device prevents, in the locked state, the rotation of the internal rotor 23 relative to the external rotor 22 in the advanced direction at the locking position. The connecting passage 45 of the second rotational angle limiting device 43 can be loaded with pressure medium by the control line 48 and a channel 49. In this way it is provided that the control valve 37 regulates both the pressure medium flows to and from the first and second pressure chambers 35, 36 and also to and from the control line 48.

Figure 5:
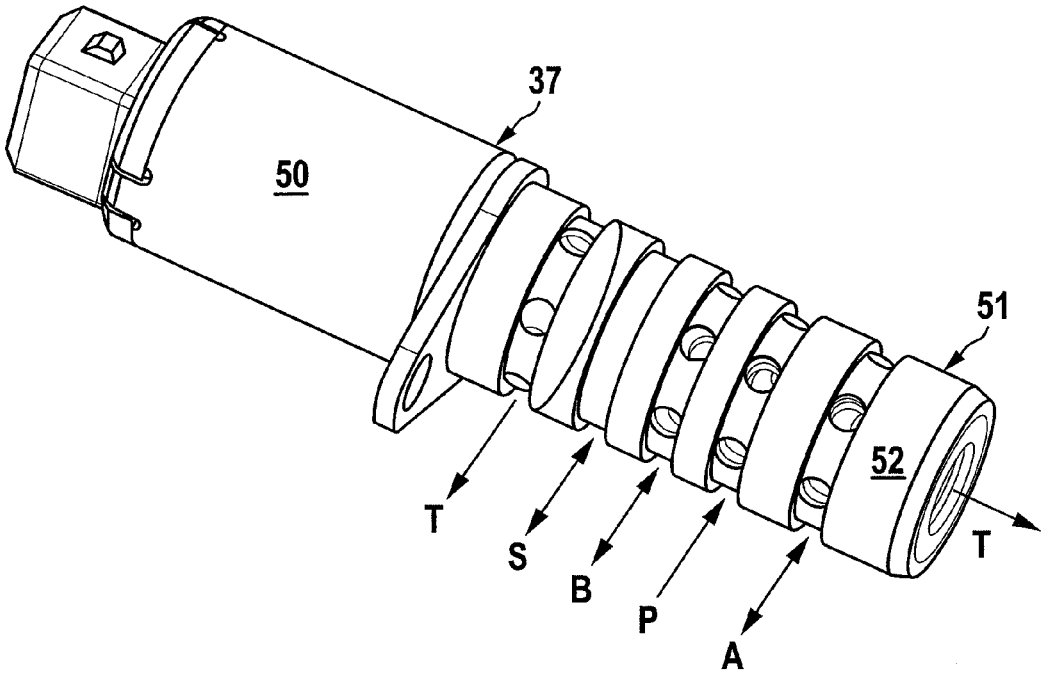
FIG. 5 is a perspective view of a control valve for controlling the device according to the invention.
Figure 6:
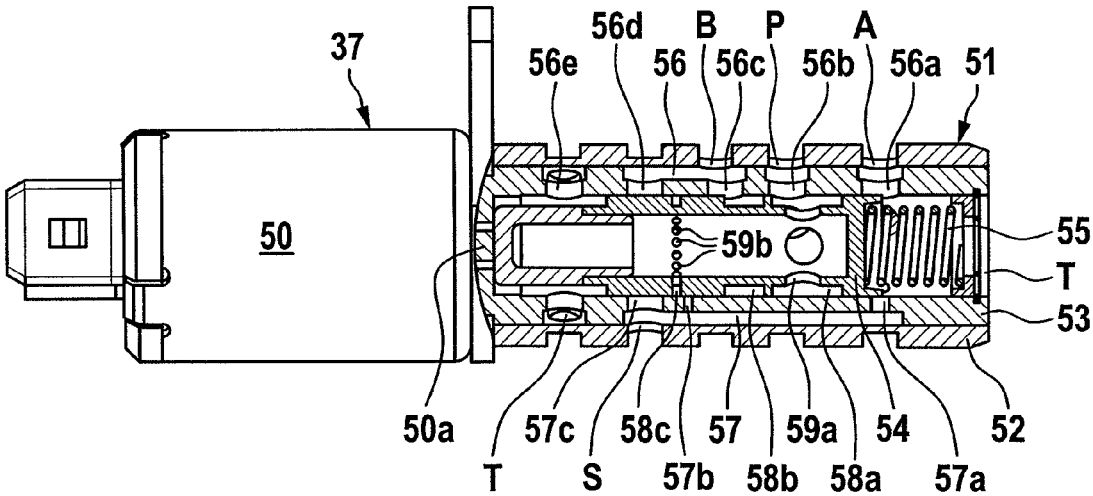
FIG. 6 is a partial longitudinal section view through the control valve from FIG. 5, FIGS. 6*a*-6*g* are longitudinal section views through the essential parts of the control valve from FIG. 6 in its different control positions.

Such a control valve 37 is shown in FIGS. 5 and 6. The control valve 37 is made from an actuator 50 and a hydraulic section 51. The hydraulic section 51 is made from a valve housing 52 of an intermediate sleeve 53 and a control piston 54. On the valve housing 52 there is a first work port A, a second work port B, an inflow port P, a control port S, and an axial and a radial outflow port T. The first work port A communicates with the first pressure medium line 38*a*. The second work port B communicates with the second pressure medium line 38*b*. The inflow port P communicates with the third pressure medium line 38*p*. The control port S communicates with the control line 48. Pressure medium can flow into a not-shown tank via the outflow ports T.

The intermediate sleeve 53 is arranged within the valve housing 52 fixed in position relative to this housing. On its outer lateral surface there is a work groove 56, a control groove 57, five work openings 56*a-e*, and three control openings 57*a-c*. The work groove 56 and the control groove 57 extend in the peripheral direction of the intermediate sleeve 53 each in a defined angle interval, wherein the two grooves 56, 57 are separated from each other hydraulically. The work ports A, B and the inflow port P are formed as radial openings in the valve housing 52, wherein the radial openings are formed exclusively in the region of the angular segment assumed by the work groove 56. Similarly, the control port S is realized by one or more radial openings that are formed exclusively in the region of the angular segment assumed by the control groove 57.

The work openings 56*a-e* communicate on one side with the interior of the intermediate sleeve 53 and on the other side with the first work port A (first work opening 56*a*), the inflow port P (second work opening 56*b*), the work groove 56 (third and fourth work opening 56*c, d*) or the radial tank port T (fifth work opening 56*e*). The work groove 56 also communicates with the second work port B. Furthermore, it can be provided to form additional grooves in the outer lateral surface of the intermediate sleeve 53 that connects the first, the second, or the fifth work opening 56*a, b, e* to the respective port A, P, T.

The control openings 57*a-c* communicate on one side with the interior of the intermediate sleeve 53 and on the other side with the control groove 57 that communicates, in turn, with the control port S.

The control piston 54 has an essentially hollow cylindrical construction and is arranged within the intermediate sleeve 53, wherein this piston can be moved by the actuator 50 against the force of a spring 55 in the axial direction relative to the intermediate sleeve 53 and the valve housing 52. The control piston 54 has three annular grooves 58*a-c* and first and second openings 59*a, b*.

The actuator 50 can be formed, for example, as an electrical actuator, wherein a magnetized armature is arranged within a coil. By exciting the coil, the armature can be shifted in the axial direction. This movement can be transmitted to the control piston 54 by a tappet rod 50*a*.

Through axial displacement of the control piston 54 within the intermediate sleeve 53, the work ports A, B and the control port S can be connected selectively to the inflow port P, the outflow port T, or none of the two.

Figure 3:
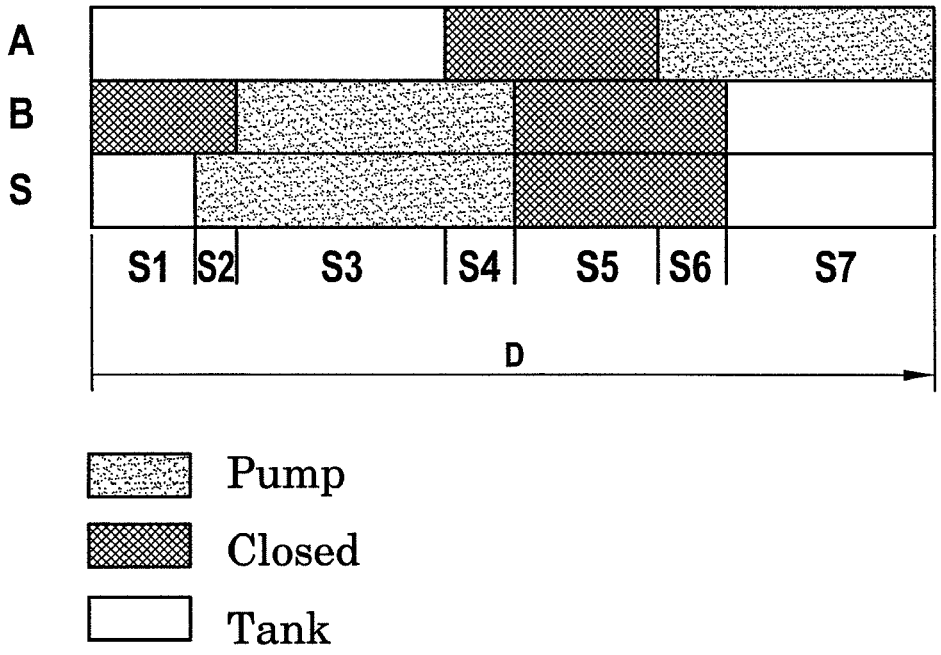
FIG. 3 is a diagram of a first control logic of a control valve of the device according to the invention.

In FIG. 3, control logic of the control valve 37 shown in FIG. 5 or FIG. 6 is shown. Here, the connections of the first work port A, the second work port B, and the control port S to the pressure medium pump or the tank are shown as a function of the excitation of the actuator 50 or the axial displacement D of the control piston 54 within the intermediate sleeve 53. The control logic can be divided into seven control positions. In this way, the control valve 37 passes through, with increasing excitation of the actuator 50 (axial displacement of the control piston 54), the control positions in the sequence: startup position S1, unlocked position S2, retarding position S3, first intermediate position S4, holding position S5, second intermediate position S6, and advancing position S7. The positions of the control piston 54 relative to the valve housing 52 or the intermediate sleeve 53 in the various control positions S1-S7 are shown in FIGS. 6*a-g*.

In the startup position S1 (FIG. 6*a*) that the control valve 37 assumes when the actuator 50 is not activated, the first work port A (via the first work opening 56*a*) and the control port S (via the first control opening 57*a*) are connected to the axial outflow port T. Thus, pressure medium is discharged from the first pressure chambers 35 and thus from the first rotational angle limiting device 42 and from the second rotational angle limiting device 43 to the tank. The second work port B is closed (connected neither to the inflow port nor to the outflow port P, T).

When transitioning from the startup position S1 to an unlocked position S2 (FIG. 6*b*), the control port S (via the second work opening 56*b*, the first annular groove 58*a*, the first opening 59*a*, the interior of the control piston 54, the second opening 59*b*, the third annular groove 58*c*, the second control opening 57*b*, and the control groove 57) is connected to the pump. The first work port A further communicates with the axial outflow port T, while the second work port B continues to be closed (analogous to FIG. 6*a*).

Figure 6A:
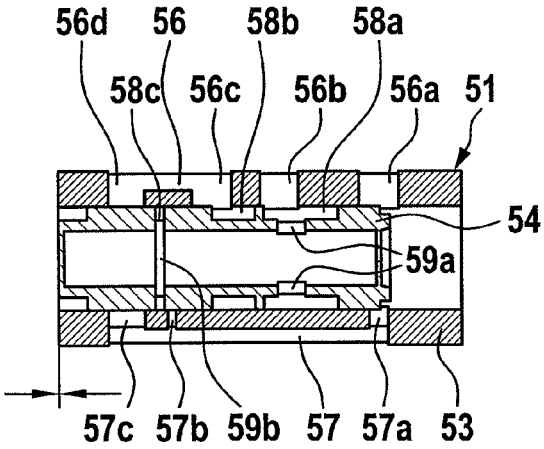
Figure 6B:
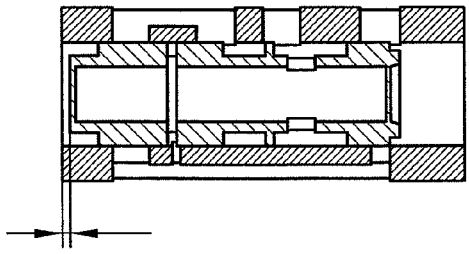

In the subsequent retarding position S3 (FIG. 6*c*), the second work port B (via the second work opening 56*b*, the second annular groove 58*b*, the third work opening 56*c*, and the work groove 56), as well as the control port S is connected to the inflow port P (analogous to FIG. 6*b*), wherein the first work port A is connected to the axial outflow port T (analogous to FIG. 6*a*).

Figure 6C:
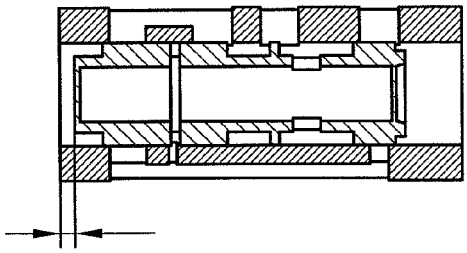
Figure 6D:
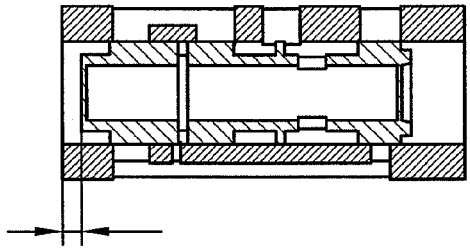

In the first intermediate position S4 (FIG. 6*d*), the first work port A is closed, while the second work port B and the control port S are connected to the inflow port P (analogous to FIG. 6*c*).

In the holding position S5 (FIG. 6*e*), both work ports A, B and the control port S are closed.

Figure 6E:
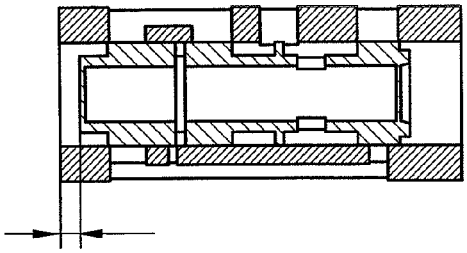

In the second intermediate position S6 (FIG. 6*f*), the first work port A (via the second work opening 56*b*, the first annular groove 58*a*, and the first work opening 56*a*) is connected to the inflow port P, while the second work port B and the control port S are closed (analogous to FIG. 6*e*).

Figure 6F:
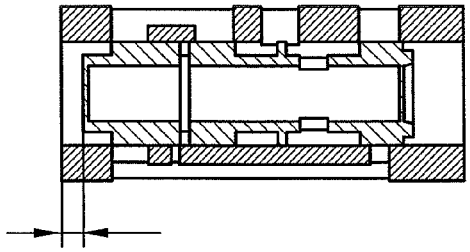
Figure 6G:
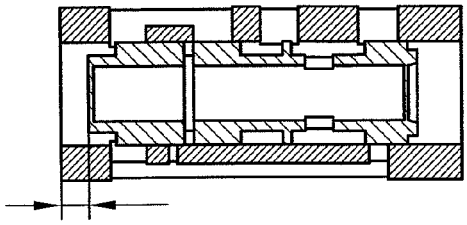

In the subsequent advancing position S7 (FIG. 6*g*), the second work port B, as well as the control port S (via the fourth work opening 56*d* or the third control opening 57*c*, the interior of the intermediate sleeve 53, and the fifth work opening 56*e*), is connected to the radial outflow port T and the first work port A is connected to the inflow port P (analogous to FIG. 6*f*).

Here, the intermediate positions S4 and S6 are to be seen as optional control positions. An alternative control logic has only the control positions S1 to S3, S5, and S7.

During the startup phase of the internal combustion engine 1, the control valve 37 is located in the startup position S1. In this phase, the hydraulic clamping of the vanes 27 within the pressure spaces 33 is generally not guaranteed due to a system pressure that is too low. For this reason, the internal rotor 23 will carry out movements oscillating opposite the external rotor 22 in the peripheral direction. These oscillations are caused by the alternating moments acting on the camshafts 6, 7, wherein the oscillations themselves appear in the locked state of the device 10. In this way, their amplitude is defined by the locking play. The oscillations result in a pumping effect, whereby residual oil present in the pressure medium channels 39*a, b* or the pressure medium lines 38*a, b* can be fed into the pressure chambers 35, 36. In this way, pressure values that are sufficient to move the rotational angle limiting devices 42, 43 into the unlocked state can be achieved within the device 10.

Through the connection of the first work port A and the control port S to the tank, this is prevented. The first pressure chambers 35, the corresponding pressure medium channels 39*a*, the first pressure medium line 38*a*, and the control line 48 are emptied and thus a pressure buildup, and with it the undesired automatic unlocking during the startup phase, in the connecting passages 45 of the rotational angle limiting devices 42, 43 is prevented.

Because the second work port B is closed in the startup position S1, the second pressure chambers 36 are not charged with pressure medium. Therefore, it is prevented that the locking pin 44 of the second rotational angle limiting device 43 is forced against the end of the connecting passage 45, which could lead to jamming. On the other hand, it is prevented that the pressure medium in the second pressure medium channels 39*b* can flow to the tank. Thus, it is guaranteed that through the oscillations of the vanes 27, small quantities of pressure medium are fed into the second pressure chambers 36, whereby the device 10 is supplied with sufficient lubricant.

After a defined time span has elapsed after which the startup process has completely ended or when a sufficient pressure level is detected in the lubricant circuit of the internal combustion engine 1 and the motor controller forces a phase change, the device 10 transitions into a regulated state until the pressure in the lubricant circuit again falls below a given level. For this purpose, the actuator 50 of the control valve 37 is excited such that this valve is led via the unlocked position S2 into the control positions S3 to S7 and is regulated, according to the setting of the phase angle, by the motor controller into one of these control positions S3-S7.

While the control valve 37 assumes the unlocked position S2, in contrast to the startup position S1, the control port S is charged with pressure medium and thus the second rotational angle limiting device 43 transitions into the unlocked state. In this way, none of the pressure chambers 35, 36 are loaded with pressure, whereby jamming of the locking pin 44 of the second rotational angle limiting device 43 in its connecting passage 45 is prevented.

As a function of the current desired or actual values of the phase position, in the locked state of the device 10, the control valve 37 assumes the control positions S3-S7. If a displacement of the phase position in the direction of more retarded intake times is forced by the motor controller, then the control valve 37 is activated such that this assumes the retarding position S3. In this position, the first pressure chambers 35 are connected to the tank and the second pressure chambers 36 are connected to the pump. Simultaneously, pressure medium is led to the connecting passage 45 of the second rotational angle limiting device 43. The locking pin 44 of the second rotational angle limiting device 43 is held in the unlocked state, while, for simultaneous emptying of the first pressure chambers 35, the pressure medium loading of the second pressure chambers 36 leads to rotation of the internal rotor 23 relative to the external rotor 22 against the rotational direction of the device 10. If the motor controller forces the phase position of the internal rotor 23 relative to the external rotor 22 to be held, then this control valve 37 is moved into the holding position S5. In this position, pressure medium is not exchanged between the pressure chambers 35, 36 and the connecting passage 45 of the second rotational angle limiting device 43 to the tank or the pressure medium pump. The vanes 27 are clamped hydraulically in the pressure space 33 and the rotational angle limiting devices 42, 43 are held in the unlocked position.

If the motor controller forces more advanced control times, then the control valve 37 is brought into the advancing position S7. In this control position, pressure medium is fed to the first pressure chambers 35, while pressure medium is discharged to the tank both from the connecting passage 45 of the second rotational angle limiting device 43 and also from the second pressure chambers 36. Consequently, a relative rotation of the internal rotor 23 relative to the external rotor 22 is caused in the rotational direction of the device 10. In addition, the locking pin 44 of the second rotational angle limiting device 43 can engage in the corresponding connecting passage 45 when these stand opposite each other.

In the intermediate positions S4 and S6, one group of pressure chambers 35, 36 is loaded with pressure medium, while there is no exchange of pressure medium between the other group of pressure chambers 35, 36 and the pump and the tank. In this way it is achieved that during the assumption or exiting of the holding position S5, the hydraulic clamping of the vanes 27 within the pressure spaces 33 is maintained.

During the stop phase of the internal combustion engine 1, the control valve 37 moves into the advancing position S7 and is held in this position for a defined time span past its standstill. Therefore, pressure medium is fed to the first pressure chambers 35, while pressure medium can flow out of the second pressure chambers 36 to the tank. This causes a relative rotation of the internal rotor 23 to the external rotor 22, wherein the internal rotor 23 is led into a position between the locking position and the maximum advanced position. Simultaneously, the control port S and thus the connecting passage 45 of the second rotational angle limiting device 43 are connected to the tank, whereby the second rotational angle limiting device 43 is moved into the locked state. In this way it is guaranteed that the internal rotor 23 moves into a position between the locking position and the maximum advanced position and is then held in this position during the entire stop process and the operating pause of the internal combustion engine 1.

In the last phase of the motor stop in which the device 10 is no longer supplied with sufficient pressure medium, the internal rotor 23 is rotated relative to the external rotor 22 in the direction of the maximum retarded position due to the drag moments acting on the camshafts 6, 7. This movement is stopped by the locked second rotational angle limiting device 43 at the locking position. Due to the lack of system pressure, the first rotational angle limiting device 42 in this position is similarly moved into the locked state, whereby a mechanical fixing of the internal rotor 22 relative to the external rotor 23 is established in the locking position. Alternatively, this process can take place during the startup phase of the internal combustion engine 1 in which the control valve 37 assumes the startup position S1. In this position, the first pressure chambers 35 and the connecting passage 45 of the first rotational angle limiting device 42 connected to these chambers are connected to the tank. The internal rotor 22 is forced into the locking position due to the drag moments acting on the camshaft 6, 7 in which the first rotational angle limiting device 42 can transition into the locked state.

During the regulated operation of the device 10 (control states S3-S7), due to the control logic shown in FIG. 3 it is guaranteed that when one group of pressure chambers 35, 36 is pressurized, the associated rotational angle limiting device 42, 43 is located in the unlocked state. Thus, a secure adjustment of the device 10 past the locking position is guaranteed.

Through the separate control of the rotational angle limiting devices 42, 43, only a small number of switch points exists in the control logic that are stored in the motor controller or must be determined by this controller. Simultaneously, the regions of the individual control positions S1-S7 increase, whereby the regulation of the control valve 37 is simplified considerably and the error susceptibility is reduced.

Figure 4:
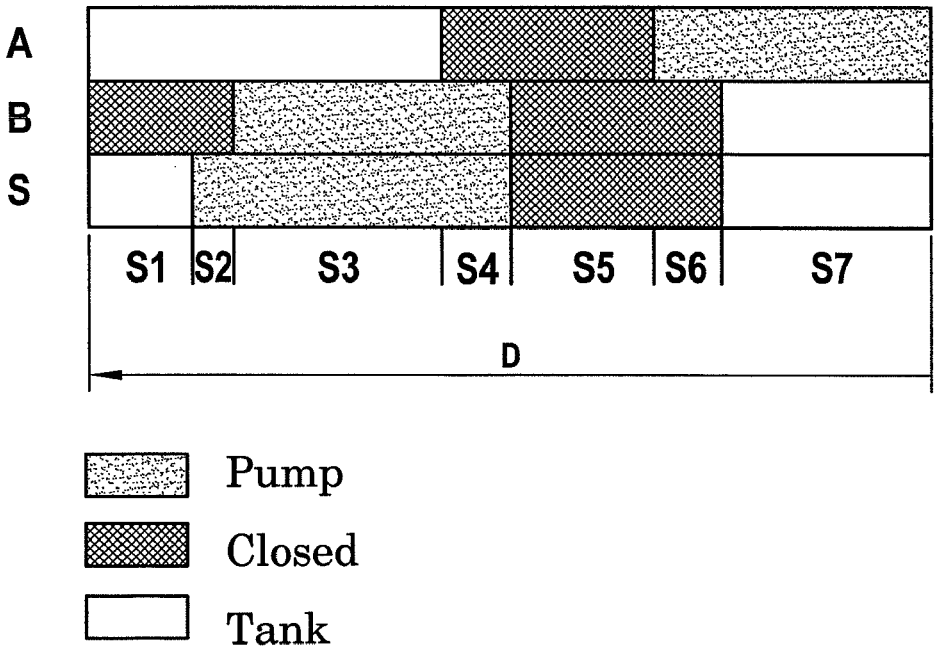
FIG. 4 is a diagram of a second control logic of a control valve of the device according to the invention.

FIG. 4 shows alternative control logic to the control logic shown in FIG. 3, wherein the sole difference consists in that the sequence of control positions S1-S7 is transposed. In this construction, the startup position S1 is assumed for a maximally activated actuator 50, while the advancing position S7 is assumed for a non-activated actuator 50.

REFERENCE SYMBOLS

1 Internal combustion engine
2 Crankshaft
3 Piston
4 Cylinder
5 Traction mechanism drive
6 Intake camshaft
7 Exhaust camshaft
8 Cams
9*a* Intake gas-exchange valve
9*b* Exhaust gas-exchange valve
10 Device
21 Chain wheel
22 External rotor
23 Internal rotor
24 Side cover
25 Side cover
26 Hub element
27 Vane
28 Vane grooves
29 Peripheral wall
30 Projection
31 Axial opening
32 Attachment element
33 Pressure space
34 Boundary wall
34*a* Advance stop
34*b* Retard stop
35 First pressure chamber
36 Second pressure chamber
37 Control valve
38*b* First pressure medium line
38*a* Second pressure medium line
38*p* Third pressure medium line
39*b* First pressure medium channel
39*a* Second pressure medium channel
40 Receptacle
41 Locking mechanism
42 Rotational angle limiting device
43 Rotational angle limiting device
44 Locking pin
45 Connecting passage
46 Spring element
47 Connecting line
48 Control line
49 Channel
50 Actuator
50*a* Tappet rod
51 Hydraulic section
52 Valve housing
53 Intermediate sleeve
54 Control piston
55 Spring
56 Work groove
56*a* First work opening
56*b* Second work opening
56*c* Third work opening
56*d* Fourth work opening
56*e* Fifth work opening
57 Control groove
57*a* First control opening
57*b* Second control opening
57*c* Third control opening
58*a* First annular groove
58*b* Second annular groove
58*c* Third annular groove
59*a* First opening
59*b* Second opening
A First work port
B Second work port
P Inflow port
T Outflow port
S Control port
D Displacement
S1 Startup position
S2 Unlocked position
S3 Retarding position
S4 First intermediate position
S5 Holding position
S6 Second intermediate position
S7 Advancing position

The invention claimed is:

1. Method for controlling a device for variably adjusting the control times of gas-exchange valves of an internal combustion engine with an external rotor and an internal rotor arranged such that it can rotate relative to the external rotor, wherein one of the internal rotor and the external rotor is drivingly connected to a crankshaft and the other of the internal rotor and the external rotor is drivingly connected to a camshaft, wherein at least one pressure space is provided and each of the pressure spaces is divided into two pressure chambers acting against each other, wherein one of the pressure chambers of each of the pressure spaces acts as an advancing chamber and the other pressure chamber acts as a retarding chamber, wherein by supplying pressure medium to the advancing chambers, while simultaneously withdrawing pressure medium from the retarding chamber, the rotor interacting with the camshaft is rotated relative to the rotor interacting with the crankshaft in a direction of a maximum advanced position, wherein by supplying pressure medium to the retarding chamber, while simultaneously withdrawing pressure medium from the advancing chamber, the rotor interacting with the camshaft is rotated relative to the rotor interacting with the crankshaft in a direction of a maximum retarded position, wherein at least one first rotational angle limiting device and one second rotational angle limiting device are provided, wherein each of the rotational angle limiting devices can assume an unlocked state and a locked state, wherein the locked state can be set by supplying pressure medium to or withdrawing pressure medium from the respective rotational angle limiting devices, wherein for a locked first and second rotational angle limiting device the internal rotor is fixed relative to the external rotor in a locking position, and the supply of pressure medium to or the withdrawal of pressure medium from the pressure chambers and the rotational angle limiting devices can be set by a control valve that has at least one inflow port, at least one outflow port, at least two work ports, and at least one separate control port, the inflow port communicates with a pressure medium source, the outflow port communicates with a tank, the first work port communicates with the advancing chamber, the second work port communicates with the retarding chamber, and the control port communicates with at least one of the rotational angle limiting devices, the method comprising:

during a startup phase of the internal combustion engine, one of the retarding chamber or the advancing chamber is connected neither to the tank nor to the pressure medium source and connecting the other of the retarding or advancing pressure chambers and the rotational angle limiting devices to the tank, and moving the control valve to an unlocking position in which the control port communicates with an inflow port of at least one of the rotational angle limiting devices and the work ports do not communicate with the inflow port.

2. Method according to claim 1, further comprising moving the first rotational angle limiting device into the locked state to prevent rotation of the rotor interacting with the camshaft relative to the rotor interacting with the crankshaft in the direction of the maximum advanced position when the locking position is assumed.

3. Method according to claim 1, further comprising moving the first rotational angle limiting device into the locked state to limit the phase position of the rotor interacting with the camshaft relative to the rotor interacting with the crankshaft to an angle region between the maximum retarded position and the locking position.

4. Method according to claim 1, further comprising moving the second rotational angle limiting device into the locked state to limit a phase position of the rotor interacting with the camshaft relative to the rotor interacting with the crankshaft to an angle region between the maximum advanced position and the locking position.

5. Method according to claim 2, further comprising during a stopping process of the internal combustion engine, connecting the advancing chambers to the pressure medium source and connecting the second rotational angle limiting device and the retarding chambers to the tank.

6. Method for controlling a device according to claim 1, wherein, in the locked state of the second rotational angle limiting device, limiting a phase position of the rotor interacting with the camshaft relative to the rotor interacting with the crankshaft to an angle region between the maximum advanced position and the locking position, and during a stop process of the internal combustion engine, connecting the advancing chambers to the pressure medium source and connecting the second rotational angle limiting device and the retarding chambers to the tank.

7. Method according to claim 6, further comprising controlling the locking state of the second rotational angle limiting device exclusively by a separate control line that does not communicate with the pressure chambers.

8. Method according to claim 7, further comprising controlling the locked state of the first rotational angle limiting device by a pressure prevailing in at least one of the advancing chambers.

9. Method according to claim 5, further comprising maintaining connections of the pressure chambers and the second rotational angle limiting device to the pressure medium source or to the tank during the stopping process of the internal combustion engine for a defined time span past a completed engine stop.

10. Device for variably adjusting the control times of gas-exchange valves of an internal combustion engine comprising:

an external rotor and an internal rotor that can rotate relative to the external rotor, wherein one of the external rotor and the internal rotor is drivingly connected to a crankshaft and the other of the external rotor and the internal rotor is drivingly connected to a camshaft, at least one pressure space is formed and each of the pressure spaces is divided into two pressure chambers acting against each other, one of the pressure chambers of each of the pressure spaces acts as an advancing chamber and the other pressure chamber acts as a retarding chamber, by supplying pressure medium to the advancing chamber while simultaneously withdrawing pressure medium from the retarding chamber, the rotor interacting with the camshaft is rotated relative to the rotor interacting with the crankshaft in a direction of a maximum advanced position, by supplying pressure medium to the retarding chamber while simultaneously withdrawing pressure medium from the advancing chamber, the rotor interacting with the camshaft is rotated relative to the rotor interacting with the crankshaft in a direction of a maximum retarded position, at least one first and one second rotational angle limiting device are provided, each of the rotational angle limiting devices can assume an unlocked state and a locked state, wherein the locked state can be set by supplying pressure medium to or withdrawing pressure medium from the respective rotational angle limiting device, for a locked first and second rotational angle limiting device, the internal rotor is fixed relative to the external rotor in a locking position, a control valve is provided that can assume several control positions and controls a supply of pressure medium to or the withdrawal of pressure medium from the pressure chambers and the rotational angle limiting devices, the control valve has at least one inflow port, at least one outflow port, at least two work ports, and at least one separate control port, the inflow port communicates with a pressure medium source, the outflow port communicates with a tank, the first work port communicates with the advancing chambers, the second work port communicates with the retarding chambers, and the control port communicates with at least one of the rotational angle limiting devices, the control valve has a startup position in which one of the work ports is connected neither to the outflow port nor to the inflow port, the other work port and the rotational angle limiting devices communicate exclusively with the outflow port in the startup position, and the control valve has an unlocking position in which the control port communicates with the inflow port and the work ports do not communicate with the inflow port.

11. Device according to claim 10, wherein an actuator is provided that can move the control valve into various control positions, and the control valve assumes the startup position for a non-activated or alternatively for a maximally activated actuator.

12. Device according to claim 10, wherein in the locked state, the first rotational angle limiting device prevents the rotation of the rotor interacting with the camshaft relative to the rotor interacting with the crankshaft in the direction of the maximum advanced position when the locking position is assumed.

13. Device according to claim 10, wherein in the locked state, the first rotational angle limiting device limits the phase position of the rotor interacting with the camshaft relative to the rotor interacting with the crankshaft to an angle region between the maximum retarded position and the locking position.

14. Device according to claim 10, wherein in the locked state, the second rotational angle limiting device limits a phase position of the rotor interacting with the camshaft relative to the rotor interacting with the crankshaft to an angle region between the maximum advanced position and the locking position.

15. Device according to claim 14, wherein the second rotational angle limiting device communicates exclusively with the control port.

16. Device according to claim 10, wherein the control valve also has a retarding position in which the first work port communicates with the tank and the second work port and the control port communicate with the inflow port.

17. Device according to claim 16, wherein the control valve also has an advancing position in which the first work port is connected to the inflow port and the second work port and the control port are connected to the tank.

18. Device according to claim 17, wherein with increasing or alternatively decreasing activation of the actuator, the control positions are assumed in the sequence: startup positions-unlocking position-retarding position-advancing position.

* * * * *